United States Patent [19]

Wagberg et al.

[11] Patent Number: 4,824,523

[45] Date of Patent: Apr. 25, 1989

[54] METHOD OF MAKING PAPER WITH HIGH FILLER CONTENT

[75] Inventors: Lars E. R. Wågberg, Kungsängen; Tom S. C. Lindström, Sollentuna, both of Sweden

[73] Assignee: Svenska Traforskningsinstitutet, Stockholm, Sweden

[21] Appl. No.: 57,720

[22] Filed: Jun. 1, 1987

Related U.S. Application Data

[63] Continuation of Ser. No. 763,439, filed as PCT SE84/00406 on Nov. 28, 1984, published as WO85/02635 on Jun. 20, 1985, abandoned.

[30] Foreign Application Priority Data

Dec. 6, 1983 [SE] Sweden ..... 8306739

[51] Int. Cl.[4] ..... D21H 3/28; D21H 3/36

[52] U.S. Cl. ..... 162/164.1; 162/164.3; 162/164.6; 162/166; 162/168.2; 162/168.4; 162/169; 162/175; 162/183

[58] Field of Search ..... 162/164.3, 164.6, 168.2, 162/168.3, 168.4, 169, 175, 183, 164.1, 166

[56] References Cited

U.S. PATENT DOCUMENTS

| | | |
|---|---|---|
| 3,592,731 | 7/1971 | Griggs . |
| 3,790,514 | 2/1974 | Economou . |
| 4,066,495 | 1/1978 | Voigt et al. . |

FOREIGN PATENT DOCUMENTS

| | | |
|---|---|---|
| 25463 | 3/1981 | European Pat. Off. . |
| 1497280 | 1/1978 | United Kingdom . |

OTHER PUBLICATIONS

Casey, *Pulp and Paper*, vol. III, 3rd ed. (1981), pp. 1456–1461, 1570, 1597, 1598, 1602–1604, 1622.

*Primary Examiner*—Peter Chin

*Attorney, Agent, or Firm*—Burns, Doane, Swecker & Mathis

[57] ABSTRACT

The invention relates to a method for producing paper by the addition of a retention - dry strength agent system. The system consists of

- cationic starch with a substitution degree of at least 0.005 in an amount of at least 1%,
- anionic high-polymer with a molecular weight greater than $10^6$ and in an amount of 0.003–0.5%, and
- cationic synthethic polymer in an amount of 0.005–0.5%.

9 Claims, No Drawings

METHOD OF MAKING PAPER WITH HIGH FILLER CONTENT

This application is a continuation of application Ser. No. 763,439, filed as PCT SE84/00406 on Nov. 28, 1984, published as WO85/02635 on Jun. 20, 1985, now abandoned.

BACKGROUND OF THE INVENTION

This invention relates to a method of papermaking, which renders it possible to make paper with a high filler content (>15%), a high retention of the filler, and substantially improved mechanical and optical properties.

In order to reduce papermaking costs, it is tried at present to increase the content of mineral fillers in the paper. Examples of such fillers also are kaolin, different types of calcium carbonate and talcum. The fillers improve the opacity and printability properties of the paper. In addition, for various reasons it is often desired to make paper with bentonite, titanium oxide, wollastonite, glass fibres, zinc pigment etc. The present invention comprises either an addition of a filler type or of mixtures of different fillers and pigment types.

Addition of fillers give rise to the technical problem that they, to an unsatisfactory degree, deteriorate the strength properties of the wet web as well as the dry paper. Traditionally different types of starches were typically added, into the stock, into the size press, or by a spray method in order to improve the strength properties. Cationic or amphoteric starches normally are used as additives to the stock at present. By derivatization of the starch it is sought to obtain a good retention of filler, pigment and other fine material on the wire and also to obtain maximum dry strength effect of the additives. It is important in this connection that the starch derivative have good affinity to fibres and fillers in the stock. This is normally achieved by cationization of the starch so that it is adsorbed to the negatively charged fibres. It is generally known that a high retention effect in a papermaking machine can be obtained by consecutively adding to the stock both a cationic starch and an anionic polymer, for example polyacrylamide. The synergistic effect is due to the fact that the two oppositely charged polymers interact with each other, although the mechanism in detail is unknown.

When it is desired that large amounts (>2%) of starch be adsorbed to fibres and fillers, it is favourable to use a relatively low-substituted cationic starch (D.S.=substitution degree of cationic groups). D.S.<0.03. There is in fact an optimum charge density of the starch corresponding to a maximum adsorption to a given stock under given chemical conditions. When such a low-substituted cationic starch is used in combination with an anionic high-polymer, however, in most cases an inferior retention effect obtained is inferior to that obtained if a high-charged starch type is chosen. While this can be counteracted to a certain degree by choosing a high-charged anionic high-polymer, but in most of the cases this does not help.

DETAILED DESCRIPTION OF PREFERRED EMBODIMENTS

We have now found that by using a low-charged cationic starch (D.S.≦0.03) in combination with an anionic high-polymer it is possible to obtain a strong synergistic effect on the retention fillers and fine material when, in addition, a cationic polymer is added. This amounts to a 3-component retention and dry strength agent system for paper with high filler contents (>15%).

The cationic starch utilized in the process can be produced from any one of the starch-producing plant species, for example maize starch, wheat starch, potato starch, rice starch, tapioca starch and the like. As the cationic substituent in our additive a tertiary amine ether or a quarternary ammonium ether group is preferred.

It is expected, however, that other cationic groups, for example primary and secondary amines, sulphonium and phosphonium groups bound with ether or ether groups to the starch, can also be used. We prefer the use of 3-chloro-2-hydroxypropyltrimethyl ammonium chloride to form cationic starch with a degree of substitution of at least 0.005, preferably between about 0.01 to about 0.035 and most preferably between about 0.01 and about 0.025. The cationic starch should be present in a proportion of 1 to 7% by weight of the stock. The three components are added to the stock before the point at which the product is formed on the web. We prefer that the cationic starch be added first to the stock, whereafter the anionic high-polymer and the cationic polymer are added separately. The anionic polymer should have a mean molecular weight (Mw) greater than $10^6$ and should comprise from about 0.003 to about 0.5% and preferably from about 0.003 to about 0.3% of the stock. The anionic polymer may be a copolymer of acrylamide and acrylic acid or 2-acrylamide 2-alkylpropane sulfonic acid.

The cationic synthetic polymer should comprises from about 0.005 to about 0.5% by weight and preferably from about 0.005 to about 0.5% by weight and preferably from about 0.005 to about 0.3% by weight of the system. Suitable cationic synthetic polymers include:

(A) Chain-reaction polymers prepared from monomers with the following structure:

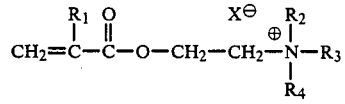

in which $X^{31}$ signifies $—I^{31}$, $—CH_3SO_4^-$ or $—Cl^-$ and $R_1$, $R_2$, $R_3$ and $R_4$ signify —H, $—CH_3$ or some other short-chain alkyl group.

(B) Modified polyacrylamides in which the polyacrylamide is reacted with HCHO and dimethylamine in accordance with the following reaction:

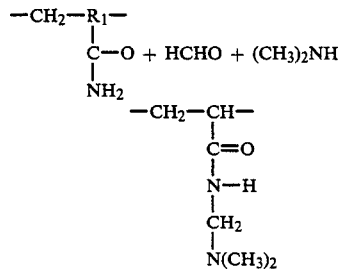

in which $R_1$ signifies —H or $—CH_3$ (C) Polydiallyldialkyl-ammonium halides prepared from monomers with the following structure:

$$(CH_2—CH—CH_2)_2—N^+R_1R_2X^{31}$$

in which $R_1$ and $R_2$ signify —H, —$CH_3$ or some other short-chain alkyl group, (D) Cationic amido-amines prepared by condensation of a dicarboxylic acid, e.g., adipic acid and a polyalkylenepolyamine e.g. diethylenetriamine, forming a polyamide of the following structure:

$$-NH(C_nH_{2n}HN)_x-CORCO-$$

in which n and x 2 and R is the divalent hydrocarbon chain of the dicarboxylic acid, which is then reacted with epichlorohydrin, fomring a cationic polyelectrolyte, (E) Condensation products formed between dicyandiamide, formaldehyde and an ammonium salt, (F) Reaction products formed between epichlorohydrin or polyepichlorohydrin and ammonia or primary or secondary amines, e.g., dimethylamine, (G) Polymers formed by reaction between ditertiary amines or secondary amines and dihalo-alkanes, (H) Polymers formed by polymerization of ethylimine, known as polyethylimines, or (I) Polymers formed by polymerization of N-(dialkylaminoalkyl)-acrylamide monomers.

The pH of the stock can vary between pH 4–9. The paper stock consists of at least 15% filler and cellulose fibres. The stock additionally can contain wet strenth agents, hydrophobization agents, waxes, antifoam agents, cleaning compounds, anti-resin agents etc. These additives normally are not critical for the function of the system. The term cellulose fibres refers either to so-called chemical pulp, for example sulphate or sulphite pulp from hardwood or softwood, or co-called mechanical pulps, groundwood pulps, refiner pulps, thermo-mechanical pulps or so-called chemical-mechanical pulps.

What is claimed is:

1. A method for manufacturing paper comprising the step of adding a dry-strength retention agent system to paper stock prior to forming the paper, said system comprising:

(i) from about 1% to about 7% by weight of a cationic starch having a degree of substitution between about 0.01 to about 0.035;

(ii) from about 0.003 to about 0.5% by weight of an anionic polymer having a mean molecular weight greater than $10^6$; comprising a copolymer of acrylamide with acrylic acid or 2-acrylamide 2-alkylpropane sulfonic acid; and (iii) from about 0.005 to about 0.5% by weight of a non-starch cationic synthetic polymer;

selected from the group consisting of:

(i) a cationic acrylic polymer;

(ii) a cationic polyacrylamide;

(iii) a polydiallyldialkyl-ammonium polymer;

(iv) a cationic condensation amido-amine polymer;

(v) a condensation product formed between dicyandiamide, formaldehyde, and an ammonium salt;

(vi) a reaction product formed between epichlorohydrin or polyepichlorohydrin and ammonia, a primary amine or a secondary amine;

(vii) a polymer formed by reacting a di-tertiary amine or secondary amine and dihalo-alkanes;

(viii) a polyethylamine formed by polymerization of ethylimine; and (ix) a polymer formed by polymerization of a N-(dialkyl-aminoalkyl)-acrylamide monomer;

wherein said paper stock comprises at least 15% by weight of a mineral filler.

2. The method of claim 1 wherein said cationic starch has a degree of substitution ranging from about 0.01 to about 0.025.

3. The method of claim 1 wherein said system comprises from about 0.003 to about 0.3% by weight of said anionic polymer.

4. The method of claim 1, wherein said system comprises from about 0.005 to about 0.3% by weight of said cationic synthetic polymer.

5. The process of claim 1 wherein said secondary amine in (vi) is dimethylamine.

6. The method of claim 1 wherein the filler is $CaCO_3$.

7. The method of claim 1 wherein said cationic synthetic polymer is:

(i) a chain reaction polymer prepared from a monomer of the formula:

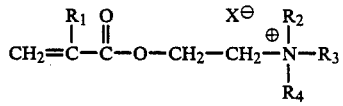

wherein X is —$I^-$, —$CH_3SO_4^-$ or —$Cl^-$ and $R_1$, $R_2$, $R_3$ and $R_4$, which are identical or different, are —H or —$CH_3$;

(ii) a modified polyacrylamide wherein polyacrylamide is reacted with formaldehyde and dimethylamine in accordance with the reaction:

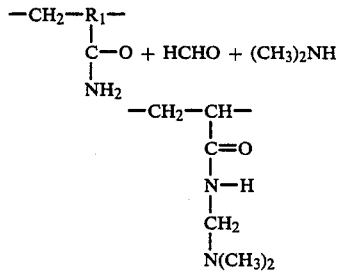

wherein R is —H or —$CH_3$;

(iii) a polydiallyldialkyl-ammonium halide prepared from a monomer of the formula:

$$(CH_2{=}CH{-}CH_2)_2{-}N^+R_1Rhd\ 2X-$$

wherein $R_1$ and $R_2$, which are identical or different are —H or —$CH_3$ and;

(iv) a cationic amido-amine prepared by condensation of a dicarboxylic acid and a polyalkylene-polyamine, said amidoamine being of the formula:

$$-NH(C_nH_{2n}HN)_x-CORCO-$$

wherein n and X are at least 2 and R is a divalent hydrocarbon derived from said dicarboxylic acid; the amidoamine then being reacted with epichlorohydrin to form a cationic polyelectrolyte.

8. The process of claim 7 wherein said dicarboxylic acid in (iv) is adipic acid.

9. The process of claim 7 wherein said polyalkylenepolyamine in (iv) is diethylenetriamine.

* * * * *